US006615522B1

(12) United States Patent
Weis

(10) Patent No.: US 6,615,522 B1
(45) Date of Patent: Sep. 9, 2003

(54) ELECTRICAL PANEL COVER AND SIGNAGE APPARATUS

(76) Inventor: Donald J. Weis, 9023 Kimber La., Lakeside, CA (US) 92040

( * ) Notice: Subject to any disclaimer, the term of this patent is extended or adjusted under 35 U.S.C. 154(b) by 0 days.

(21) Appl. No.: 09/910,249

(22) Filed: Jul. 20, 2001

(51) Int. Cl.[7] ..... G09F 7/12
(52) U.S. Cl. ..... 40/594; 174/66; 40/584
(58) Field of Search ..... 40/594, 638, 584; 220/241, 376, 4.02; 174/66

(56) References Cited

U.S. PATENT DOCUMENTS

| | | | | | |
|---|---|---|---|---|---|
| 1,258,730 | A | | 3/1918 | Wood | |
| 4,280,633 | A | * | 7/1981 | Boros | 114/211 |
| 5,005,623 | A | | 4/1991 | Webster | |
| 5,077,452 | A | * | 12/1991 | Mathers et al. | 174/66 |
| 5,114,792 | A | | 5/1992 | McWilliams et al. | |
| D338,044 | S | | 8/1993 | Rusiewicz | |
| 5,348,780 | A | | 9/1994 | Boggs et al. | |
| D393,487 | S | | 4/1998 | Cunitz et al. | |
| 5,811,729 | A | * | 9/1998 | Rintz | 174/66 |
| 5,829,622 | A | * | 11/1998 | Neuman | 220/230 |
| 5,899,010 | A | * | 5/1999 | Peck | 40/594 |
| 5,929,379 | A | * | 7/1999 | Reiner et al. | 174/66 |
| 6,098,323 | A | * | 8/2000 | McGuiness | 40/124.191 |

* cited by examiner

*Primary Examiner*—William L. Miller

(57) ABSTRACT

An electrical panel cover and signage apparatus for protecting an electrical panel and indicating government installation codes. The electrical panel cover and signage apparatus includes a device for protecting an electrical panel and indicating government code. A cover member has a front wall having a peripheral edge. A peripheral wall is attached to and extends away from the peripheral edge. The front wall has a generally rectangular shape. Electrical construction code indicia are positioned on an outer surface of the front wall. The cover is positionable over the electrical panel.

1 Claim, 2 Drawing Sheets

ELECTRICAL PANEL COVER AND SIGNAGE APPARATUS

BACKGROUND OF THE INVENTION

1. Field of the Invention

The present invention relates to covering members and more particularly pertains to a new electrical panel cover and signage apparatus for protecting an electrical panel and indicating government installation codes.

2. Description of the Prior Art

The use of covering members is known in the prior art. More specifically, covering members heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,114,792; U.S. Pat. No. 5,348,780; U.S. Pat. No. 393,487; U.S. Patent No. 5,005,623; U.S. Pat. No. 1,258,730; and U.S. Des. Pat. No. 338,044.

While these devices fulfill their respective, particular objectives and requirements, the aforementioned patents do not disclose a new electrical panel cover and signage apparatus. The inventive device includes a device for protecting an electrical panel and indicating government code. A cover member has a front wall having a peripheral edge. A peripheral wall is attached to and extends away from the peripheral edge. The front wall has a generally rectangular shape. Electrical construction code indicia are positioned on an outer surface of the front wall. The cover is positionable over the electrical panel.

In these respects, the electrical panel cover and signage apparatus according to the present invention substantially departs from the conventional concepts and designs of the prior art, and in so doing provides an apparatus primarily developed for the purpose of protecting an electrical panel and indicating government installation codes.

SUMMARY OF THE INVENTION

In view of the foregoing disadvantages inherent in the known types of covering members now present in the prior art, the present invention provides a new electrical panel cover and signage apparatus construction wherein the same can be utilized for protecting an electrical panel and indicating government installation codes.

The general purpose of the present invention, which will be described subsequently in greater detail, is to provide a new electrical panel cover and signage apparatus apparatus and method which has many of the advantages of the covering members mentioned heretofore and many novel features that result in a new electrical panel cover and signage apparatus which is not anticipated, rendered obvious, suggested, or even implied by any of the prior art covering members, either alone or in any combination thereof.

To attain this, the present invention generally comprises a device for protecting an electrical panel and indicating government code. A cover member has a front wall having a peripheral edge. A peripheral wall is attached to and extends away from the peripheral edge. The front wall has a generally rectangular shape. Electrical construction code indicia are positioned on an outer surface of the front wall. The cover is positionable over the electrical panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electrical panel cover and signage apparatus apparatus and method which has many of the advantages of the covering members mentioned heretofore and many novel features that result in a new electrical panel cover and signage apparatus which is not anticipated, rendered obvious, suggested, or even implied by any of the prior art covering members, either alone or in any combination thereof.

It is another object of the present invention to provide a new electrical panel cover and signage apparatus which may be easily and efficiently manufactured and marketed.

It is a further object of the present invention to provide a new electrical panel cover and signage apparatus which is of a durable and reliable construction.

An even further object of the present invention is to provide a new electrical panel cover and signage apparatus which is susceptible of a low cost of manufacture with regard to both materials and labor, and which accordingly is then susceptible of low prices of sale to the consuming public, thereby making such electrical panel cover and signage apparatus economically available to the buying public.

Still yet another object of the present invention is to provide a new electrical panel cover and signage apparatus which provides in the apparatuses and methods of the prior art some of the advantages thereof, while simultaneously overcoming some of the disadvantages normally associated therewith.

Still another object of the present invention is to provide a new electrical panel cover and signage apparatus for protecting an electrical panel and indicating government installation codes.

Yet another object of the present invention is to provide a new electrical panel cover and signage apparatus which includes a device for protecting an electrical panel and indicating government code. A cover member has a front wall having a peripheral edge. A peripheral wall is attached to and extends away from the peripheral edge. The front wall has a generally rectangular shape. Electrical construction code indicia are positioned on an outer surface of the front wall. The cover is positionable over the electrical panel.

Still yet another object of the present invention is to provide a new electrical panel cover and signage apparatus that protects an electrical panel or junction box from scratches and paint splattering while also reminding an installer of regulations regarding the installation of the electrical panel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
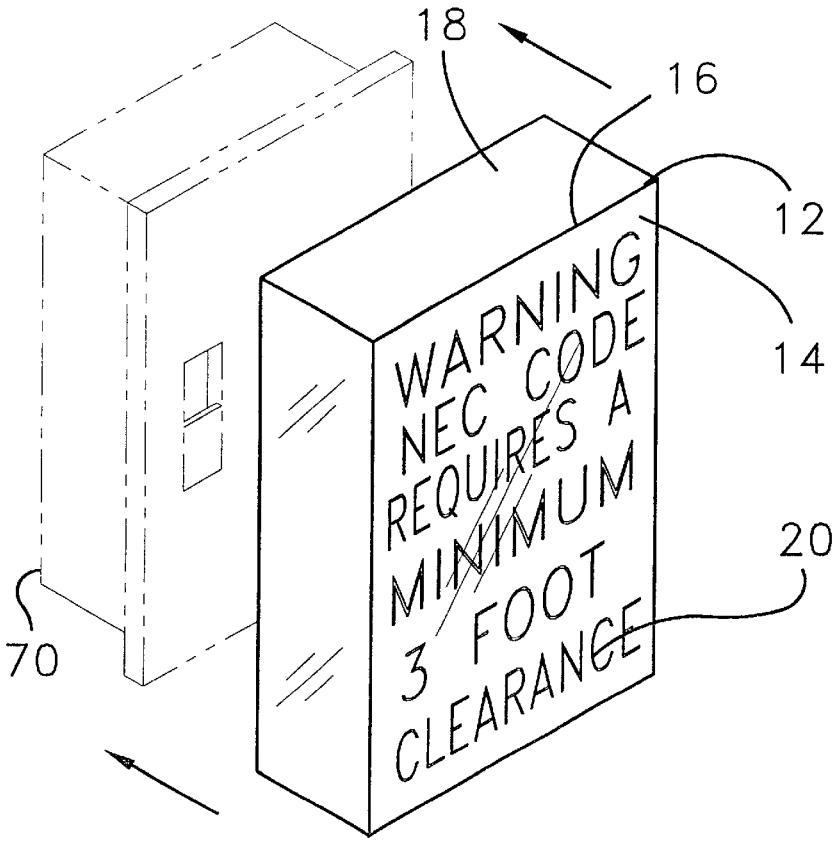
FIG. 1 is a schematic perspective view of a new electrical panel cover and signage apparatus according to the present invention.
Figure 2:
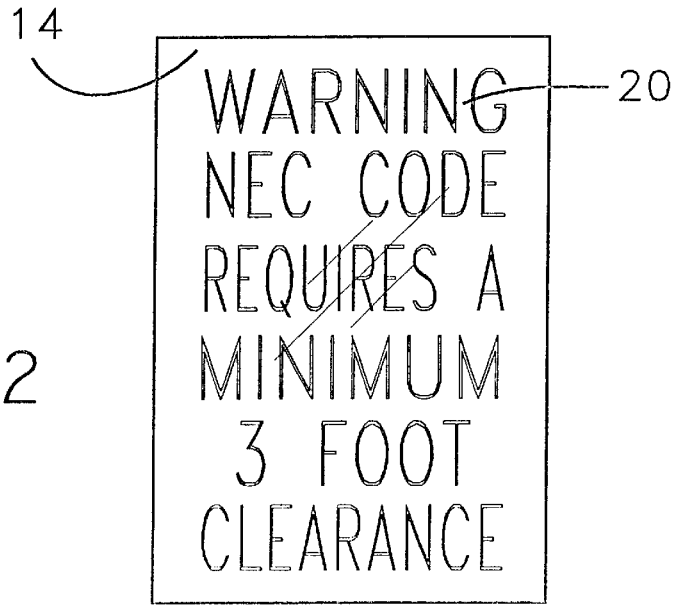
FIG. 2 is a schematic front view of the present invention.
Figure 3:
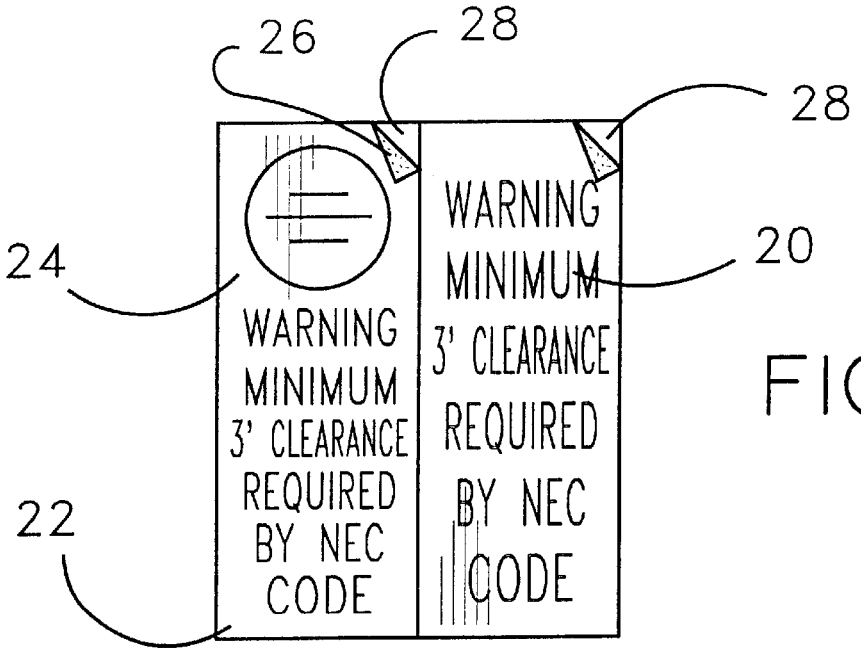
FIG. 3 is a schematic front view of the present invention.
Figure 4:
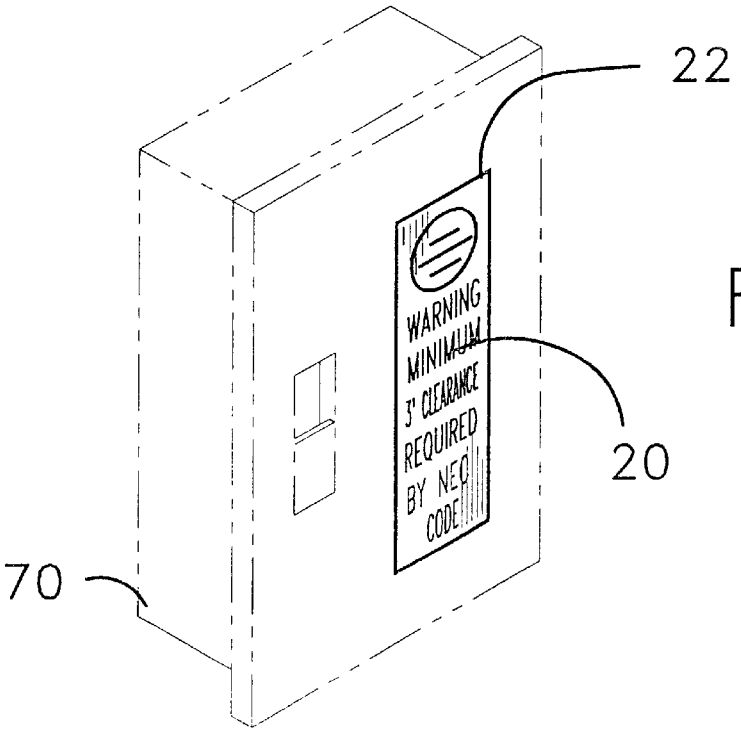
FIG. 4 is a schematic perspective view of the present invention.

With reference now to the drawings, and in particular to FIGS. 1 through 4 thereof, a new electrical panel cover and signage apparatus embodying the principles and concepts of the present invention and generally designated by the reference numeral 10 will be described.

As best illustrated in FIGS. 1 through 4, the electrical panel cover and signage apparatus 10 generally comprises a device for protecting an electrical panel 70 and indicating government code. The device 10 includes a cover member 12 having a front wall 14 having a peripheral edge 16. A peripheral wall 18 is attached to and extends away from the peripheral edge 16. The front wall 14 preferably has a generally rectangular shape. Electrical construction code indicia 20 are positioned on an outer surface of the front wall 14. The code indicia preferably relates to the spatial requirements of mounting an electrical junction box 70 to ensure that the users correctly install the box. The cover member 12 preferably comprises a flexible plastic material. The cover 12 is positionable over the electrical panel 70 so that the indicia 20 are obvious when a person begins to mount the electrical panel 70.

A plurality of sheet members 22 each has a first side 24 and a second side 26. The sheet members 22 each comprise a plastic material. Each of the first sides 24 has electrical code indicia 20 thereon. Each of the second sides 26 is statically coupled to a panel 28 such that the sheet members 22 are removably attached to the panel 28. The second sides 26 of the sheet members 22 may be statically coupled to the electrical panel 70. This may be done either before the cover 12 is placed over the electrical panel 70 or after the cover 70 is removed to serve as a further reminder of the code regarding the installation of the electrical panel 70 or junction box.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the a art, it is not desired to limit the invention to the exact construction and operation shown and described, and accordingly, all suitable modifications and equivalents may be resorted to, falling within the scope of the invention.

I claim:

1. A electrical panel cover and signage combination device for protecting an electrical panel, the electrical panel having a back wall a perimeter wall extending outwardly from the back wall and a cover member defining an interior space, said device comprising:

a cover member having a front wall having a peripheral edge, a peripheral wall being rigidly attached to and extending away from said peripheral edge, said peripheral wall and front wall enveloping the cover member and perimeter wall of the electrical panel, said front wall having a generally rectangular shape, electrical construction code indicia being positioned on an outer surface of said front wall, said cover member comprising a flexible plastic material, wherein said cover member is positionable over the electrical panel; and a plurality of sheet members each having a first side and a second side and comprising a plastic material, each of said first sides having electrical construction code indicia thereon, each of said second sides being statically coupled to a panel such that said sheet members are removably attached to said panel, wherein said second sides of said sheet members may be statically coupled to the electrical panel.

* * * * *